United States Patent [19]

Thomas

[11] 4,057,000

[45] Nov. 8, 1977

[54] MECHANISM FOR DEEP OCEAN INSTRUMENTATION REMOTE RELEASE

[75] Inventor: Geoffrey Owen Thomas, Bethesda, Md.

[73] Assignee: The United States of America as represented by the Secretary of the Navy, Washington, D.C.

[21] Appl. No.: 724,831

[22] Filed: Sept. 20, 1976

[51] Int. Cl.[2] ..... F16B 37/10

[52] U.S. Cl. ..... 85/33; 285/DIG. 21

[58] Field of Search ..... 85/33, DIG. 1; 285/21, 285/DIG. 21, 34, 18, 2, 3, 373; 403/DIG. 4

[56] References Cited

U.S. PATENT DOCUMENTS

| | | | |
|---|---|---|---|
| 3,253,653 | 5/1966 | Layne | 285/3 X |
| 3,299,767 | 1/1967 | Royer | 85/DIG. 1 X |
| 3,788,928 | 1/1974 | Wise | 285/21 X |

FOREIGN PATENT DOCUMENTS

| | | | |
|---|---|---|---|
| 6,401,292 | 8/1965 | Netherlands | 285/21 |
| 748,454 | 5/1956 | United Kingdom | 285/21 |

*Primary Examiner*—Ramon S. Britts
*Attorney, Agent, or Firm*—R. S. Sciascia; Philip Schneider; Melvin L. Crane

[57] ABSTRACT

A simple, quick, quiet load-release device which comprises a standard threaded nut cut into three sections along its length. The three sections are held together by use of a heat meltable tape which is wrapped around the nut. A resistance wire is laid between layers of the tape and upon application of a current through the resistance wire, the tape melts permitting the nut sections to separate and release any load supported by the release device.

11 Claims, 3 Drawing Figures

MECHANISM FOR DEEP OCEAN INSTRUMENTATION REMOTE RELEASE

BACKGROUND OF THE INVENTION

The present invention relates to remote release devices and more particularly to a quiet, quick release for remotely releasing a load.

There are many situations where it may become necessary and/or desirable to release units which are held together by a nut and bolt combination. Situations exist aboard ship, on shore, or in oceanic research involving buoys, instrumentation for collecting data or samples, acoustical devices and other instruments used in ocean engineering.

Heretofore, explosive devices, solenoids and motor driven cams have generally been used for release of desired objects. These devices either produce noise or are subject to unreliability from malfunctions due to corrosion or other fouling. Also, explosive devices are potentially dangerous and may cause injury if activated in the presence of personnel.

SUMMARY OF THE INVENTION

The present release device is formed by a three-section nut which is released by an electrical current that melts a binding tape, on call. Upon melting the tape, the three-sectioned nut separates, thereby releasing the bolt and the load held in place by the bolt. The bolt-nut separation may be aided by the use of spring washers surrounding the bolt and reacting against the load.

DETAILED DESCRIPTION

Figure 1:
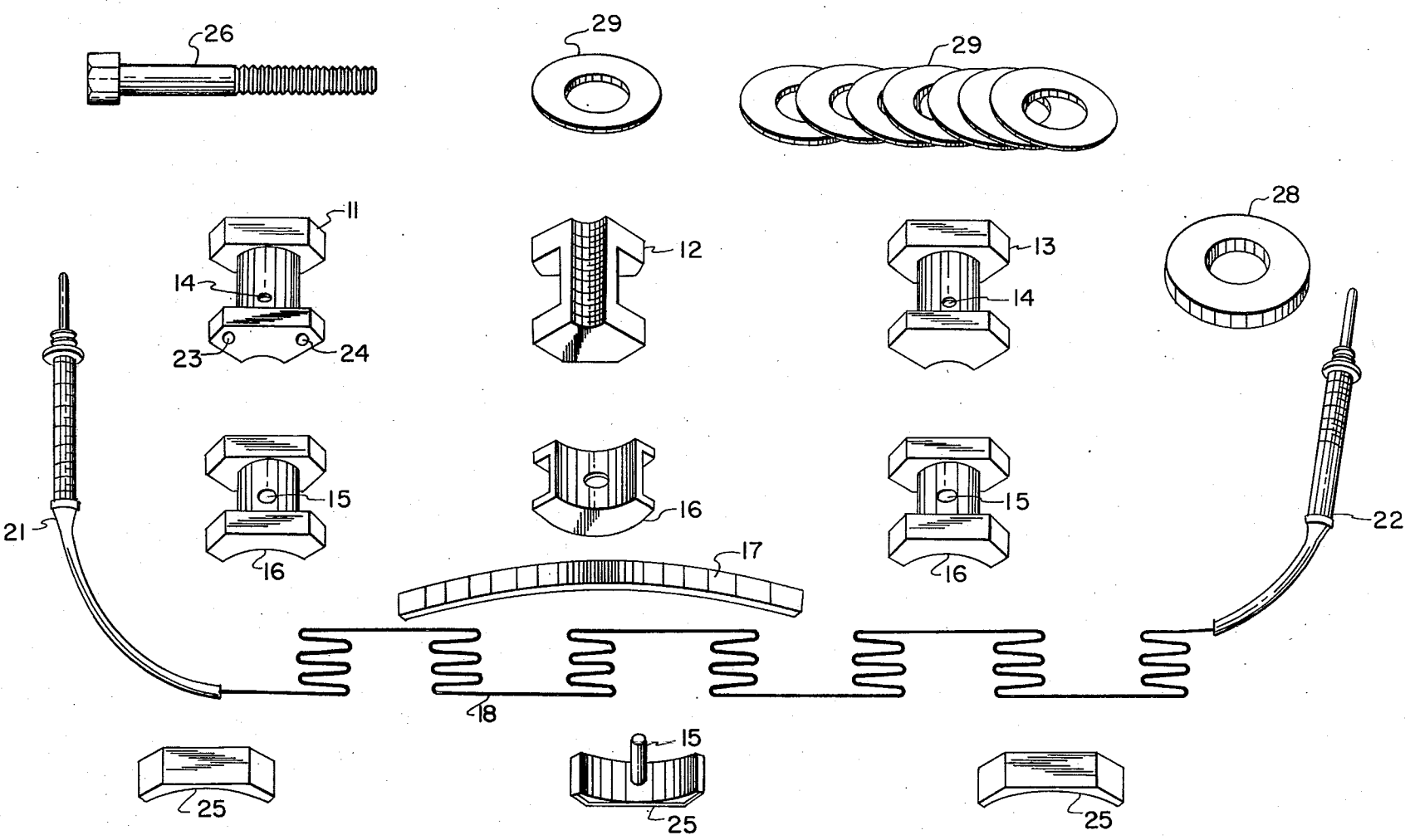
FIG. 1 illustrates a view of the various parts of a disassembled device.

Now referring to the drawings, there is shown by illustration a simple, quiet release device made in accordance with the teaching of this invention. The Device includes a hexagonal threaded nut 10 turned into a bobbin shape and segmented into three equal sections 11, 12 and 13 along its length. The material of the nut may be brass or bronze, for example. Each of the sections include along the bobbin surface a threaded hole 14 which receives the end of a screw 15 therein which secures a section 16 of a bushing for example Teflon thereon to provide an electrically insulated and heat-resistant surface.

Figures 2, 3:
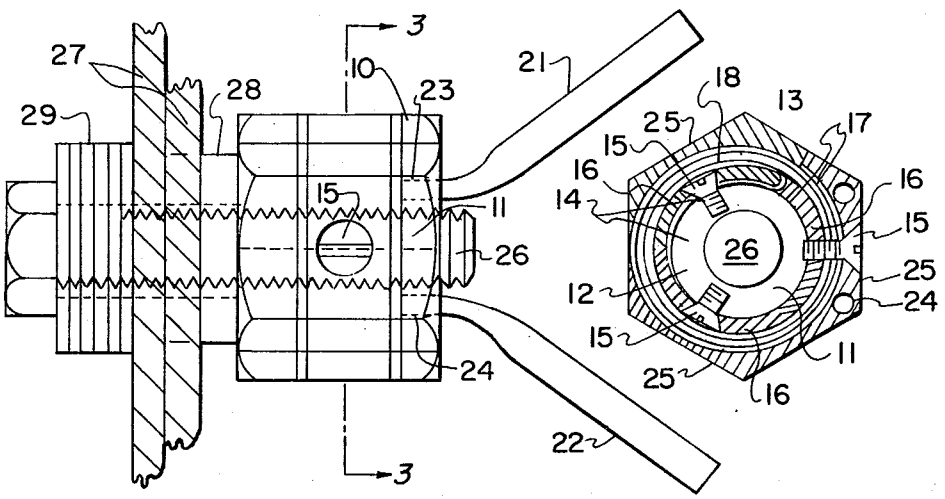
FIG. 2 illustrates a side view of an assembled device.
FIG. 3 is a cross-sectional view along lines 3—3 of the device illustrated in FIG. 2.

The nut is held together by use of an appropriate heat-meltable tape 17 which may be fabricated from polypropylene, for example. The tape is wrapped around the bushing sections positioned on the bobbin surface of the nut. An electrically conductive "heater" wire 18, such as a Nichrome wire in the form of a sine-wave as shown in FIG. 1, is wrapped between layers of the tape as shown in FIG. 3. The heater wire is connected at its ends to underwater pigtail leads 21 and 22 which are fed through apertures 23 and 24 on the outer end of one of the nut sections to connect the heater wire to an electrical signal source for supplying a current thereto when desired. The heater wire is sprayed with a waterproof coating such as RTV silicone rubber to prevent contact with seawater or any other matter which may effect the wire. External insulator sections 25, which may be made of Teflon, for example, are secured on the outside of the tape to provide an electrical and heat insulator around the outside of the heater wire. Bolt 26 is passed through the object 27 to be secured and the assembled nut is threaded onto the bolt.

In order to reduce friction from side ways movement of the bolt during separation, a washer 28, which maybe made of Teflon, is placed between the object and the nut. To provide an aid in insuring separation of the nut sections from the bolt, spring washers 29 may be placed upon the bolt, between the bolt head and the object being secured in place. The spring washers may be placed below the object as shown in FIG. 2, above the object, between the washer 28 and the surface of the object, or below and above as desired. The bolt passing through the object being held should be a loose fit with shank extending through the object to avoid the possibility that the bolt may bind within the hole in the object thereby preventing separation.

In assembly, the nut sections 11, 12 and 13 are held in place and the three-section electrical and heat insulating bushing is assembled onto the bobbin area of the nut, by mechanically securing two sections by use of screws 15. One end of the meltable tape is secured under one end of one of the electrical/heat insulator sections and wound around the three-section insulator. Subsequent to winding the first turn of the tape, one end of the heater wire is held in place and wound with the tape as the tape circumscribes the nut section. The tape circumscribes the nut one revolution prior to starting of the heater wire and is wound one revolution on the outside of the heater wire and secured in place mechanically by the outer heat insulator 25 by use of screw 15 which passes through all layers of the tape and is threaded into the nut section 11. The heater wire is placed such that the saw-tooth configurations are located adjacent the segment boundaries so that the heat will be concentrated in the region of the nut segmentation and the ends are connected to the pigtail leads which pass through the holes in the nut section 11. The outer two section insulator are not mechanically secured to the nut section but are fastened to the tape by bonding with a suitable bonding material such as silicone or polyurethane rubber. The nut is now ready for threading onto the bolt for securing an object as desired as shown in FIG. 2. Once the nut has been secured in place, the assembly may be sprayed with a protective coating such as a light coating of silicone or polyurethane rubber to protect the nut assembly from the elements.

In order to prevent potential creep of the tape when assembled, the tape is prestressed to 50 lbs. tension for a suitable period of time such as one week. Also, during assembly of the sectioned nut, the tape is pretensioned to 50 lbs. during wrapping onto the sectioned-nut.

Once the quick-release device has been assembled and secured onto a load, it will hold the load until an electrical current is passed through the resistance wire which melts the tape. Upon melting, the tape will not hold the sectioned nut together; therefore, the nut will separate and release the load. It is known that the hoop tension of a nut is about 10% of the axial tension; therefore, the tape must be sufficiently strong to prevent nut separation until desired. The number of turns of the tape on the nut will be determined by the load and the strength of the tape. It has been determined that a voltage of about 25 volts or higher will suffice to melt the tape with a Nichrome resistance wire of about 5 ohms.

It is well known that a reaction will take place when two dissimilar metals are secured together. Therefore, it will be obvious to one skilled in the art that the bolt, the hole in the object to be held in place through which the bolt passes or both may be coated with Teflon or some other material to prevent a reaction between the bolt and the object being held. A simple Teflon bushing could be used for this purpose.

Under some loading conditions, it may be necessary to use a bolt and/or nut with nonstandard thread geometries in order to support and subsequently release the object being held.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. A simple, quiet, load-release device for use with a threaded bolt in securing a load comprising:

a threaded nut, said nut machined circumferentially along a portion of its outer surface to have the shape of a bobbin and severed into three equal sections along its length;

a meltable tape for wrapping in layers around said nut sections when assembled into a whole and within the machined portion of said nut to prevent radial disassembly; and an electrical resistance means for assembly between the layers of meltable tape, whereby a suitable electrical current passed through said resistance means generates heat and melts said tape permitting the sections of said nut to separate and release the load.

2. A load-release device as claimed in claim 1, which includes:

an electrical/heat insulator means for surrounding said nut between the outer surface of said nut and said tape wrapped around said nut.

3. A load-release device as claimed in claim 1 which includes:

a heat insulator means for surrounding said tape wrapped around said nut.

4. A load-release device as claimed in claim 1 in which:

a section of said severed nut includes axially aligned apertures through which electrical leads pass and are connected with said electrical resistor wire means.

5. A load-release device as claimed in claim 2 which includes:

heat insulator means for surrounding said tape wrapped around said nut.

6. A load-release device as claimed in claim 5 in which the insulator means is Teflon.

7. A simple, quiet load-release device for securing a load for quick remote release comprising:

a threaded nut, said nut cut circumferentially along a portion of its outer surface to form the shape of a bobbin and severed into three equal sections along its length;

a meltable tape wrapped in layers around said nut sections assembled into its whole with the tape within the bobbin to prevent radial disassembly;

electrical resistance means secured between a layer of said tape; and a threaded bolt for threading into said nut, whereby a load to be released is held by said bolt passing through a load holding means and threaded into said nut.

8. A load-release device as claimed in claim 7 which includes:

electrical/heat insulator means surrounding said nut between the outer surface of said nut and said tape wrapped around said nut.

9. A load-release device as claimed in claim 7 which includes:

heat insulator means surrounding said tape wrapped around said nut.

10. A load-release device as claimed in claim 8 which includes:

heat insulator means surrounding said tape wrapped around said nut.

11. A load-release device as claimed in claim 10 which includes:

a Teflon coating on said bolt portion passing through said load-holding means to prevent any electrical effect between the bolt and the load-holding means.

* * * * *